US005513805A

United States Patent [19]

Fisher et al.

[11] Patent Number: 5,513,805

[45] Date of Patent: May 7, 1996

[54] FIBER SEPARATION METHOD AND APPARATUS

[76] Inventors: Gordon L. Fisher, 7501 El Roble Ct., Bakersfield, Calif. 93309; Alex G. Wright, 2314 N. Enos Ct., Visalia, Calif. 39292

[21] Appl. No.: 414,017

[22] Filed: Mar. 31, 1995

[51] Int. Cl.[6] ..... B02C 23/14; B07B 9/00

[52] U.S. Cl. ..... 241/18; 209/23; 209/30; 209/33; 241/23; 241/60; 241/73; 241/101.2; 241/24.29

[58] Field of Search ..... 209/23, 30, 33, 209/12, 31, 3, 22; 241/18, 19, 24, 60, 79.1, 79, 25, 73, 101.2, 23

[56] References Cited

U.S. PATENT DOCUMENTS 3,854,585 12/1974 Herkes ..... 209/3
4,300,267 11/1981 Winch et al. ..... 209/22 X
5,316,150 5/1994 Fisher .

*Primary Examiner*—Mark Rosenbaum
*Attorney, Agent, or Firm*—Mark D. Miller

[57] ABSTRACT

An apparatus and method for reaching a 99% separation of bast and core fibers from herbaceous fiber producing plants using a series of pre-separation cleaning and conditioning steps which place the bast and core fibers in a better condition for separation before they are actually separated. The harvested fiber plants are cut at a specified length. These fibers are then introduced into a conditioning apparatus which breaks up and dries, but does not yet separate the bast and core fibers. The conditioned fibers are then introduced into an auger and feeder which distributes the dried fiber over up to four identical separation lines. Each line includes at least one core separator made up of a large rotating spiked cylinder partially surrounded by a spiked, grated housing, a smaller rotating spiked cylinder which produces an air flow, and an upwardly moving inclined conveyor having openings therein. The heavier woody core fiber is thrown, shaken or dropped through the grated housing and/or conveyor openings and removed to the core cleaner. The remaining bast fiber may then be introduced into a second identical core separator where this separation process is repeated, or it may be introduced into the multi-saw bast fiber opener with a non-positive feed control. The opener includes many rolls which further clean and separate the bast fiber from the core. The bast fiber is then blown upward into an air line separator from which the fiber exits into a bale press for compression into bales for shipment or storage.

19 Claims, 20 Drawing Sheets

FIBER SEPARATION METHOD AND APPARATUS

BACKGROUND OF THE INVENTION

The present invention relates to fiber separation, and more particularly to a new and improved method and apparatus for separating the long outer bast fibers from the short woody inner core fibers of annual herbaceous fiber producing plants.

1. Field of the Invention

Many uses have been developed for the desirable long outer bast fibers of annual herbaceous fiber producing plants such as Kenaf and Crotalaria. When properly separated, these clean outer bast fibers are soft and hemp-like and can be used for a variety of purposes including, among other things: as packing material; in carpet pads and other non-woven pads; in paper products; as an absorbing medium for liquids such as oil and water; in rope and cordage products; bio-degradable netting products for prevention of soil erosion; in jute bags; for burlap; in the making of 100% Kenaf pellets and pellets made by combining Kenaf and Polypropylene pellets; and the like. Clean separation of the outer bast fibers from the inner core fibers is essential for these fibers to be readily used in these products. The cleaner the fibers, the more easily they can be used.

Separation of the outer bast fibers has the effect of producing the woody inner cores as a byproduct. These cores can also be used for such things as a bedding medium for animals, potting soils, medium density fiber boards, flour as a filler for the plastic industry, or oil absorption.

2. Description of the Prior Art

In 1993 one of the applicants herein developed a method and apparatus for separating bast fiber from core fiber which resulted in U.S. Pat. No. 5,316,150 (Fisher) issued in 1994. The method and apparatus disclosed in the Fisher patent have been dramatically improved as disclosed herein. Fisher describes a method and apparatus including no less than eight separate steps and machines. Among other things, Fisher teaches back to back incline separators, a core sizer, a jet air separator and a four cylinder fiber cleaner. Each of these steps and machines have been eliminated from the present invention.

In addition, the present invention embodies a new approach which includes a newly developed pre-separation drying and conditioning apparatus and method. Also, a new concept in the core fiber sizing and separation process has been embodied in the present invention which will save more of the desirable bast fiber. Other notable differences found in the present invention but not in Fisher include the use of vacuum separators, an auger distributor which allows simultaneous operation of as many as four (4) parallel fiber separation lines or tracks, and a new micro fiber opener cleaner.

These additions, deletions and modifications provide the present invention with more efficiency yet fewer components than Fisher and, most importantly, improved separation of bast and core fiber of over ninety-nine percent (99%).

SUMMARY OF THE INVENTION

The present invention is able to reach a 99% separation of bast and core fibers using fewer components by providing a herbaceous fiber separation method and apparatus using a series of pre-separation cleaning and conditioning steps which place the bast and core fibers in a better condition for separation before they are actually separated. A minimal number of separation steps and devices are needed after the pre-conditioning takes place to obtain a very high percentage of separation. The present invention can separate a large volume of fiber by virtue of a set of up to four independent parallel separation lines which may be operated simultaneously. A new micro fiber separator receives the fibers from the four separation lines. A new core cleaner returns lost separated bast fibers to the main line resulting in less waste.

The method and apparatus of the present invention starts with the harvested fiber plants being cut at a specified length. These fibers are then introduced into the conditioning apparatus. No separation of bast or core fiber occurs during the conditioning process in the conditioning apparatus. The first apparatus breaks up the wet clumps of harvested plants. Then, the broken up clumps are introduced into a piping conduit filled with rapidly moving hot air. The clumps move through a sufficient length of conduit to raise their temperature and begin a drying process. Then, the partially dried clumps are introduced into an inclined fiber dryer separator which moves the clumps upward while breaking them into smaller and smaller pieces as the hot air is pulled downward through a screen. These smaller dried clumps of bast and core fiber then exit the conditioning apparatus and are introduced into an auger to begin the separation process.

The first step in the separation process is the auger and feeder which distributes the dried fiber over up to four identical separation lines. Each line includes at least one core separator made up of a large rotating spiked cylinder partially surrounded by a spiked, grated housing, a smaller rotating spiked cylinder which produces an air flow, and an upwardly moving inclined conveyor having openings therein. The heavier woody core fiber is thrown, shaken or dropped through the grated housing and/or conveyor openings and removed to the core cleaner.

The remaining bast fiber may then be introduced into a second identical core separator where this separation process is repeated, or it may be introduced into the multi-saw bast fiber opener with a non-positive feed control. The opener includes a saw evener roll, a pair of saw opener rolls, a saw feeder, and a saw cleaner roll. The many saw rolls of the opener further clean and separate the bast fiber from the core. The bast fiber is then blown upward into an air line separator from which the fiber exits into a bale press for compression into bales for shipment or storage.

The core removed from the separator(s) and from the multi-saw opener is transported on conveyors to the core cleaner. In the core cleaner, the core drops onto a moving flat conveyor belt where it is brought under a rapidly rotating spiked shaft. The ends of the spikes are set to be approximately one and one half inches (1½") above the conveyor. The rapid rotation of the spiked shaft blows any remaining bast fiber away from the heavier core. A suction tube takes this bast fiber back to the main line where it is re-introduced just before the air line separator so that it may be bailed with the other bast fiber. The leftover core may then be sized, stored or discarded.

It is therefore a primary object of the present invention to provide a method an apparatus which separates the outer bast fibers from the woody inner core fibers of annual herbaceous fiber producing plants.

It is a further important object of the present invention to provide a highly efficient method and apparatus for separating over ninety-nine percent (99%) of bast fibers from inner core fibers of such annual herbaceous fiber producing plants as Kenaf and Crotalaria.

It is a further object of the present invention to provide a method for separating bast and core fibers from herbaceous fiber producing plants which includes a pre-separation conditioning process in order to facilitate better separation.

It is a further object of the present invention to provide an apparatus for separating bast and core fibers from herbaceous fiber producing plants which utilizes blower fans, air tubes and vacuum ports as well as gravity to facilitate the movement of fibers through the system.

It is a further object of the present invention to provide an apparatus for separating bast and core fibers from herbaceous fiber producing plants which includes up to four distinct separation lines in order to accommodate a high volume of fiber.

It is a further object of the present invention to provide an apparatus for separating bast and core fibers from herbaceous fiber producing plants which includes a core cleaner which removes bast fibers from discarded core and returns them to the system with other bast fibers for ultimate bailing.

It is a further object of the present invention to provide a reliable mechanical method and apparatus for producing clean bast fibers from herbaceous fiber producing plants that are ninety-nine percent (99%) free of inner core fibers.

It is a further important object of the present invention to provide a reliable mechanical method and apparatus for producing clean inner core fibers from herbaceous fiber producing plants.

It is a further object of the present invention to provide a reliable method and apparatus for producing long bast fibers from herbaceous fiber producing plants that are sufficiently free of short woody inner core fibers that they may be readily used in producing packing materials, pads, paper products, absorption materials, rope and cordage products, bio-degradable netting for soil improvements and anti-erosion, jute bags, burlap, in the making of 100% Kenaf pellets and pellets made by combining Kenaf and Polypropylene pellets, and the like.

It is a further object of the present invention to provide a reliable method and apparatus for producing short inner core fibers from herbaceous fiber producing plants that may be used for such things as bedding for animals, potting soils, medium density fiber boards, flour as a filler for the plastic industry, or oil absorption materials and the like.

Additional objects of the invention will be apparent from the detailed descriptions and the claims herein.

DETAILED DESCRIPTION OF THE DRAWINGS

Figure 1:
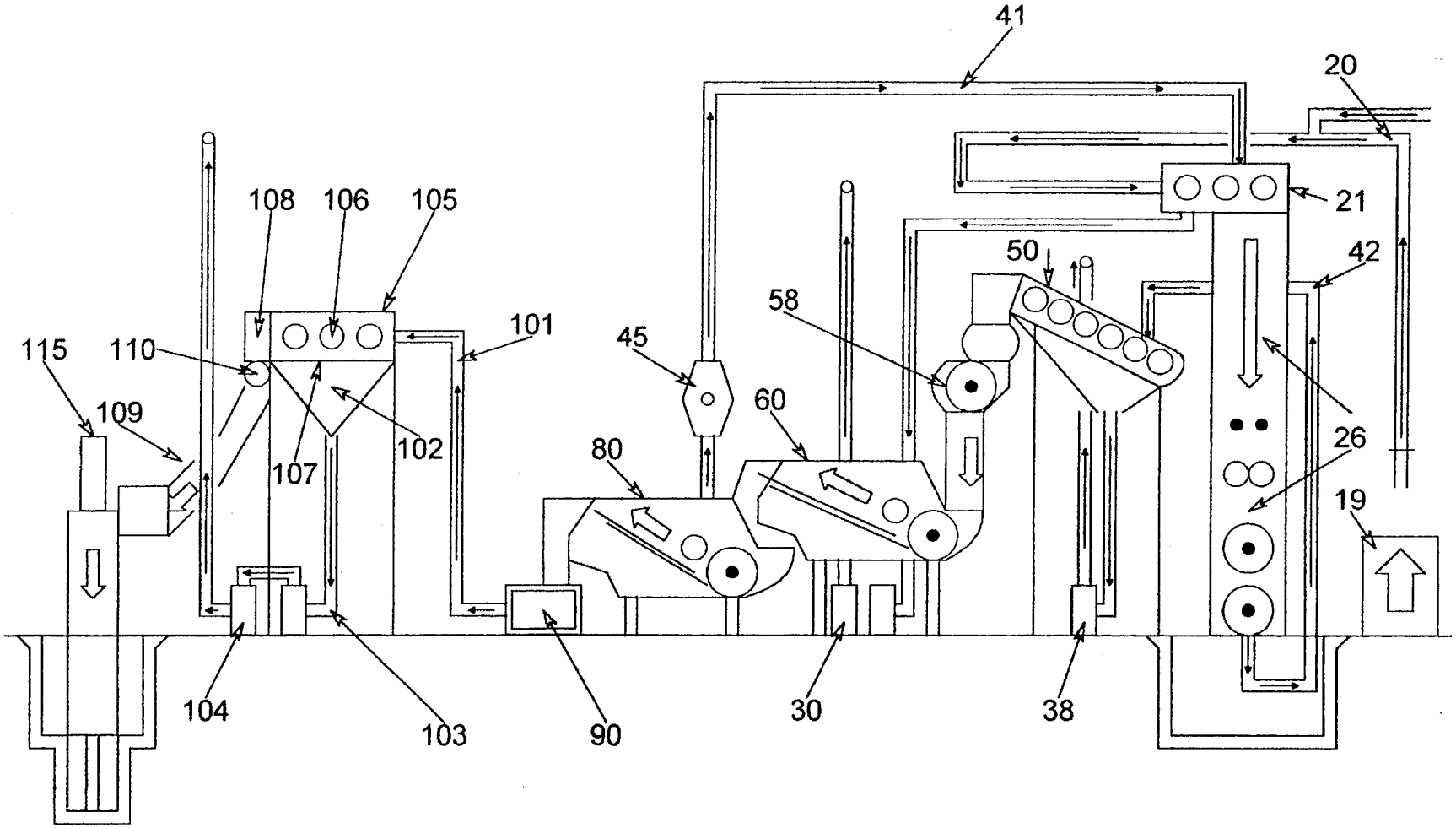
FIG. 1 is a diagrammatic side view of the apparatus of the present invention showing the flow of bast fibers through the pre-conditioning, separation and bailing processes.
Figure 2:
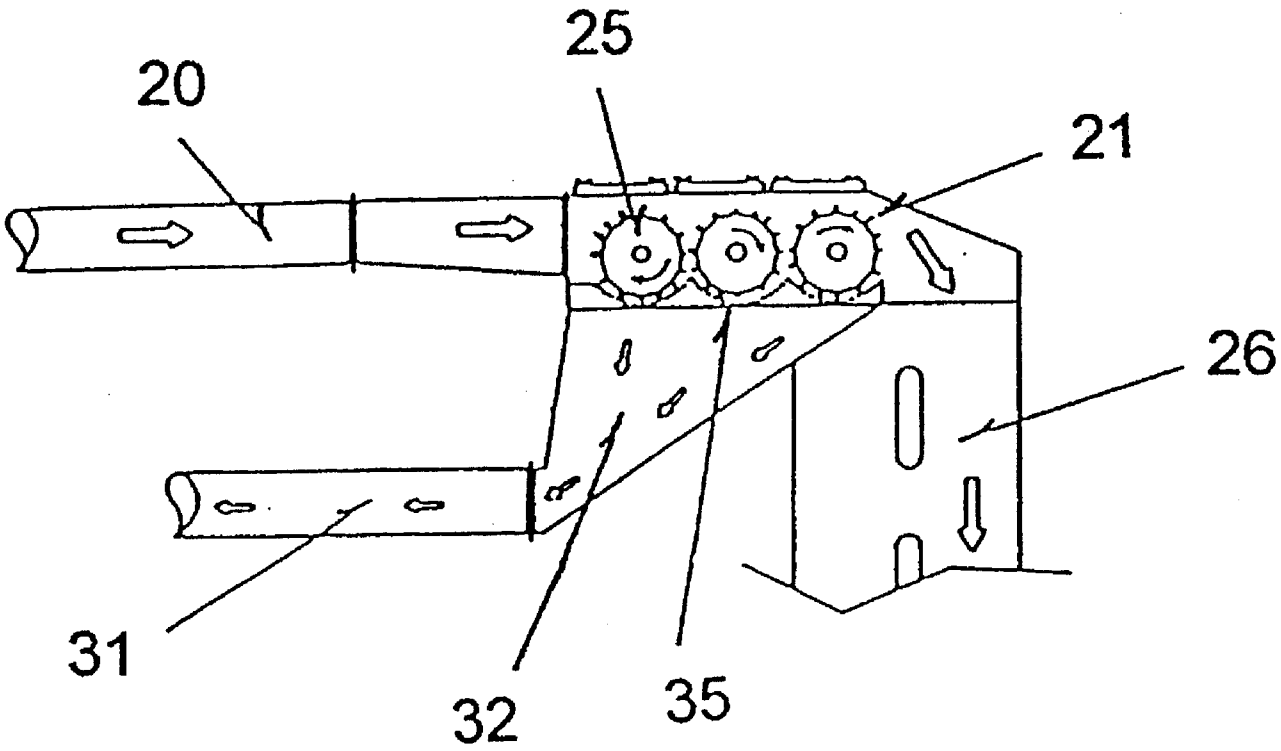
FIG. 2 is a diagrammatic side view of the intake apparatus of the present invention.
Figure 3:
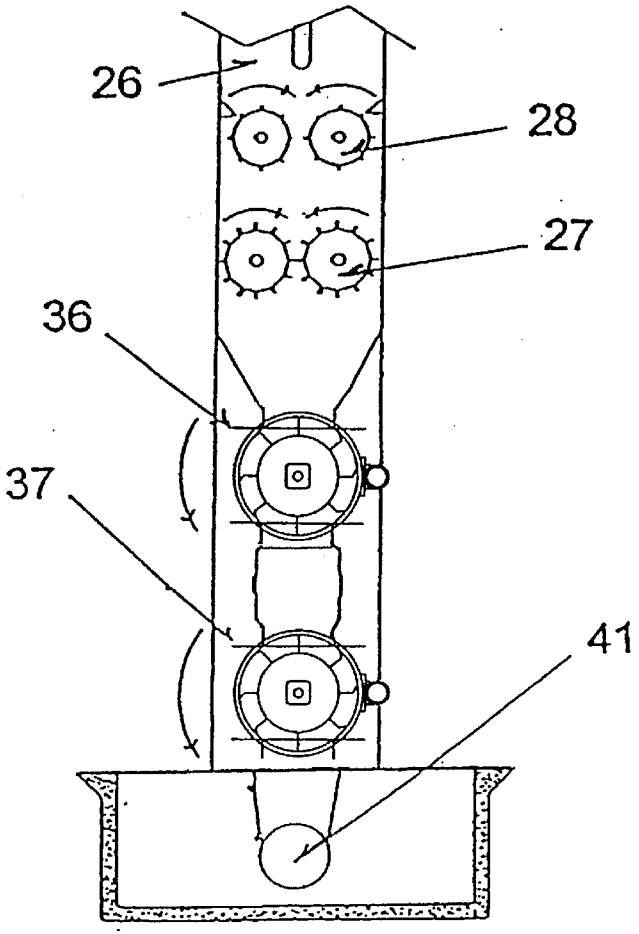
FIG. 3 is a diagrammatic side view of the feed control mechanism used to control the amount of fiber introduced into the system.

Referring to the drawings wherein like reference characters designate like or corresponding parts throughout the several views, and referring particularly to FIGS. 1 through 8, it is seen that the pre-conditioning portion of the invention includes an inlet pipe 20 attached to a transition area 21 where a series of rotatable spiked cylinders 25 are mounted. Air is drawn through the transition area 21 using a set of high pressure fans 30 attached to a set of suction pipes 31 and a large funnel 32 (see detail FIG. 2). This causes a suction in inlet pipe 20 which draws up the fiber material 19. The fiber 19 is brought into contact with rotating spiked cylinders 25 which break up the fiber into clumps 29. A perforated screen 35 prevents the fiber clumps 29 from being pulled through the funnel 32 and suction pipes 31. Instead, these clumps are moved through the transition 21 into the feed chamber 26 where they encounter an auto feed control 28 which controls the amount of fiber introduced into the system (see FIGS. 2 and 3). The volume of fiber introduced can be changed by varying the speed of rotation of cylinders 28. The fiber clumps that pass through the feed control 28 next encounter a set of spiked cylinders 27 which further break up the clumps as they drop into a pair of vacuum wheels 36 and 37.

Figure 4:
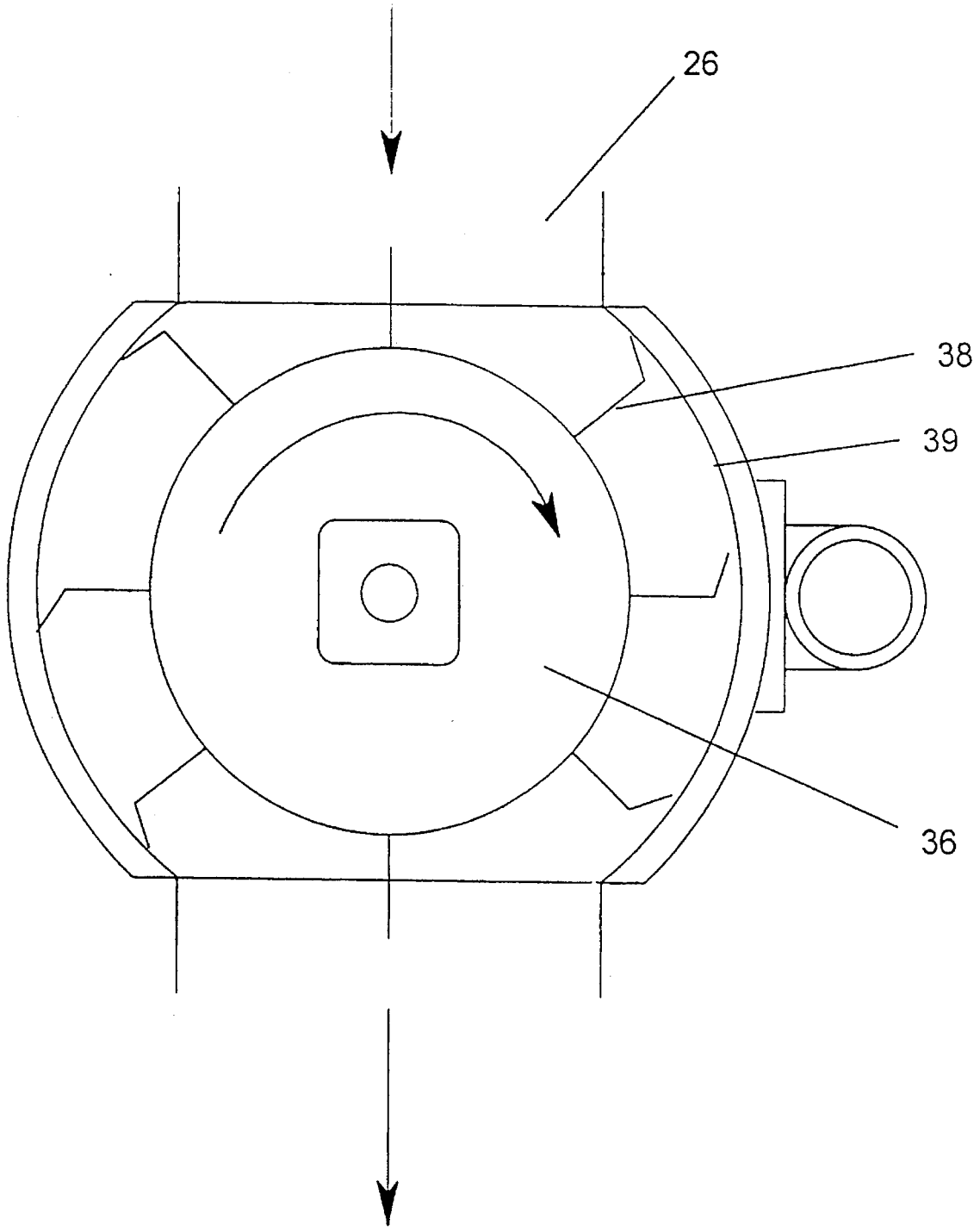
FIG. 4 is a detail view of one of the vacuum wheels of the feed mechanism shown in FIG. 3 (empty).
Figure 5:
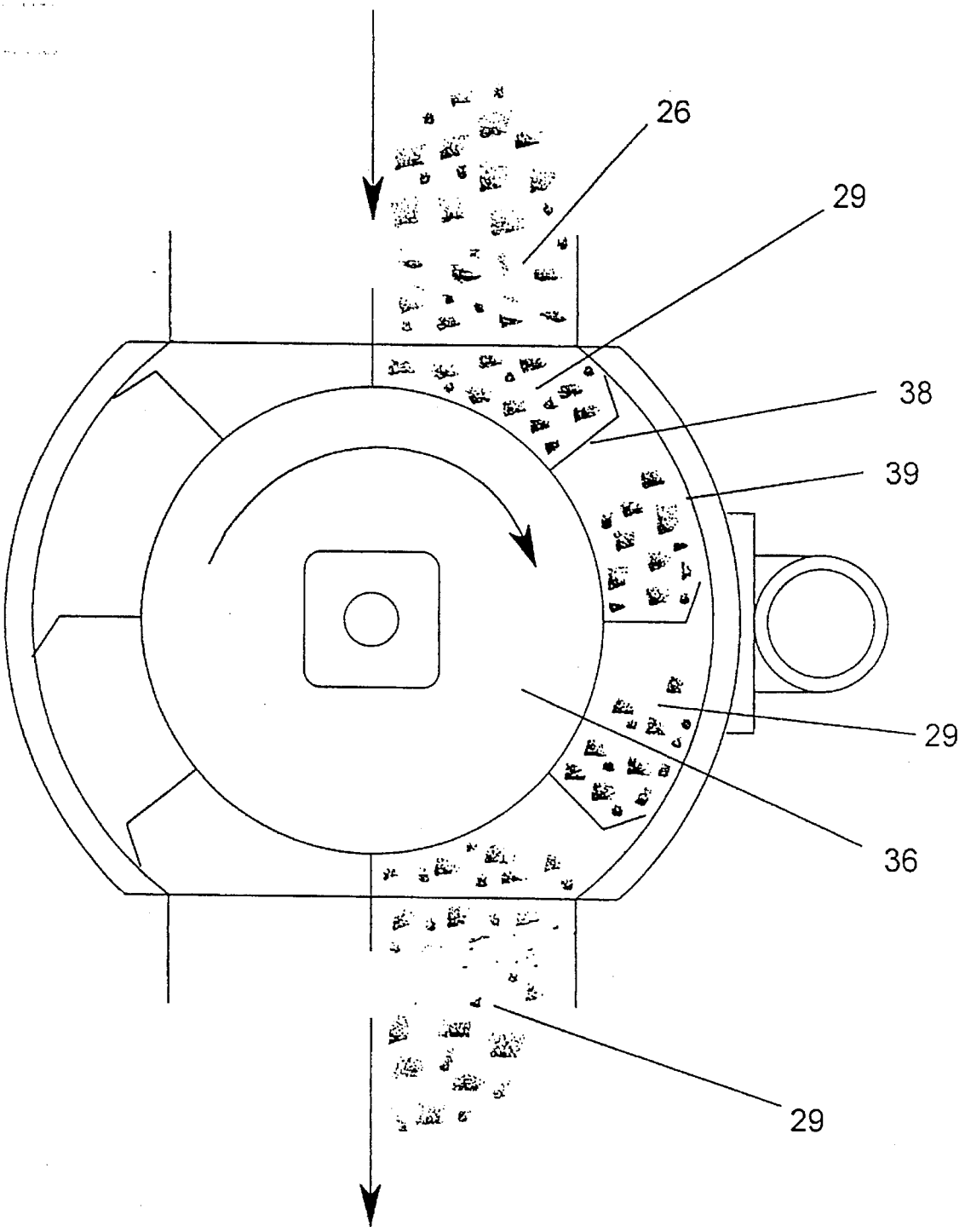
FIG. 5 is a detail view of one of the vacuum wheels of FIG. 3 showing clumps of fiber material passing through it.

Detail of the action of the vacuum wheels is shown in FIGS. 4 and 5. These wheels 36 and 37 allow the clumps 29 of fiber to be moved through the feed chamber 26 while preventing air from entering or exiting. This helps maintain the suction through pipe 20, and prevents upward suction through the feed chamber 26. As the flexible fins 38 of wheels 36 and 37 rotate, they touch the outer edge 39 of the of the vacuum wheel forming an airtight seal. Clumps of fiber 29 ride down on the fins as they rotate as shown in FIG. 5 eventually dropping through to the hot air conduit 40.

Figure 6:
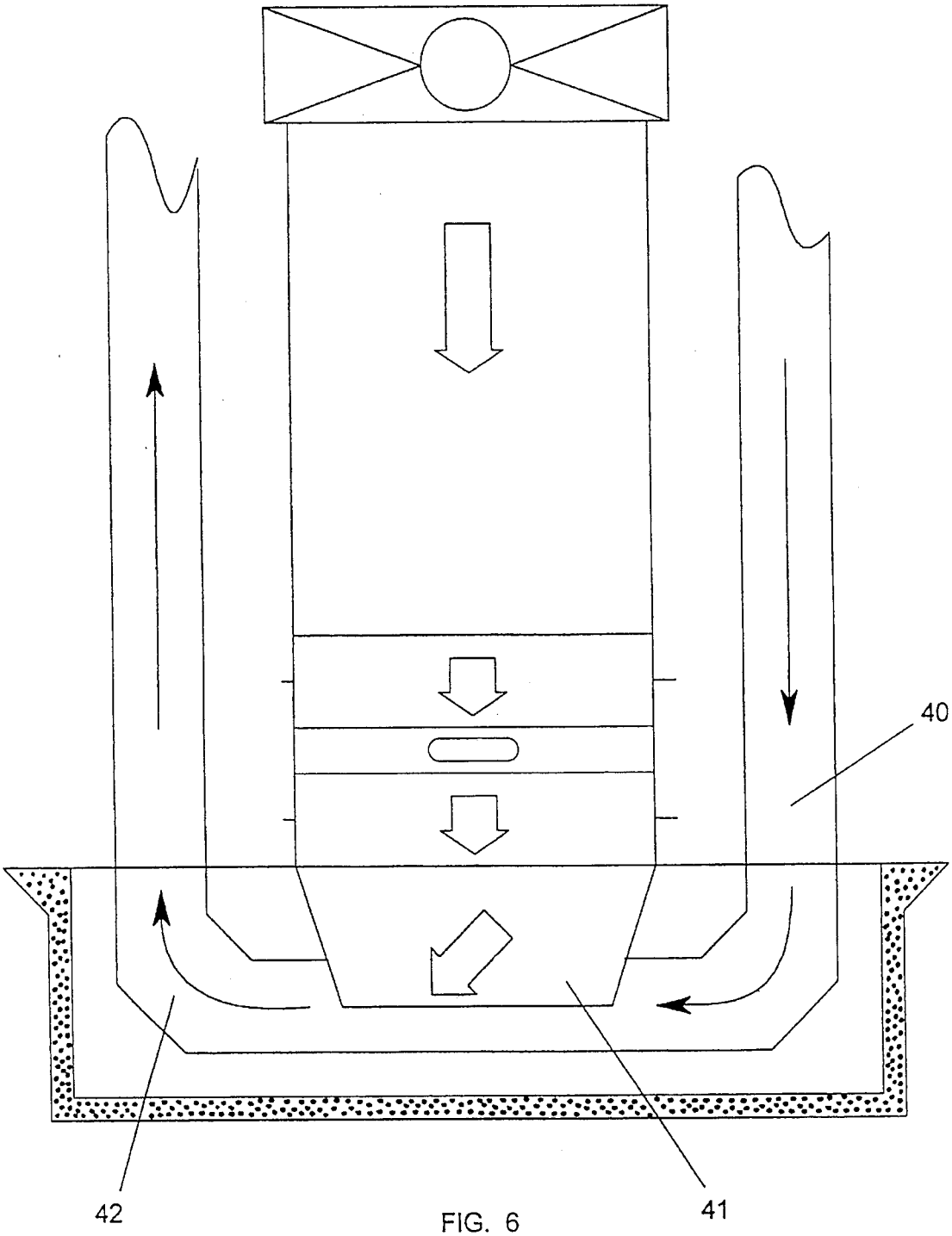
FIG. 6 is a detail view of the bottom of the feed mechanism shown in FIG. 3 illustrating the flow of air.
Figure 7:
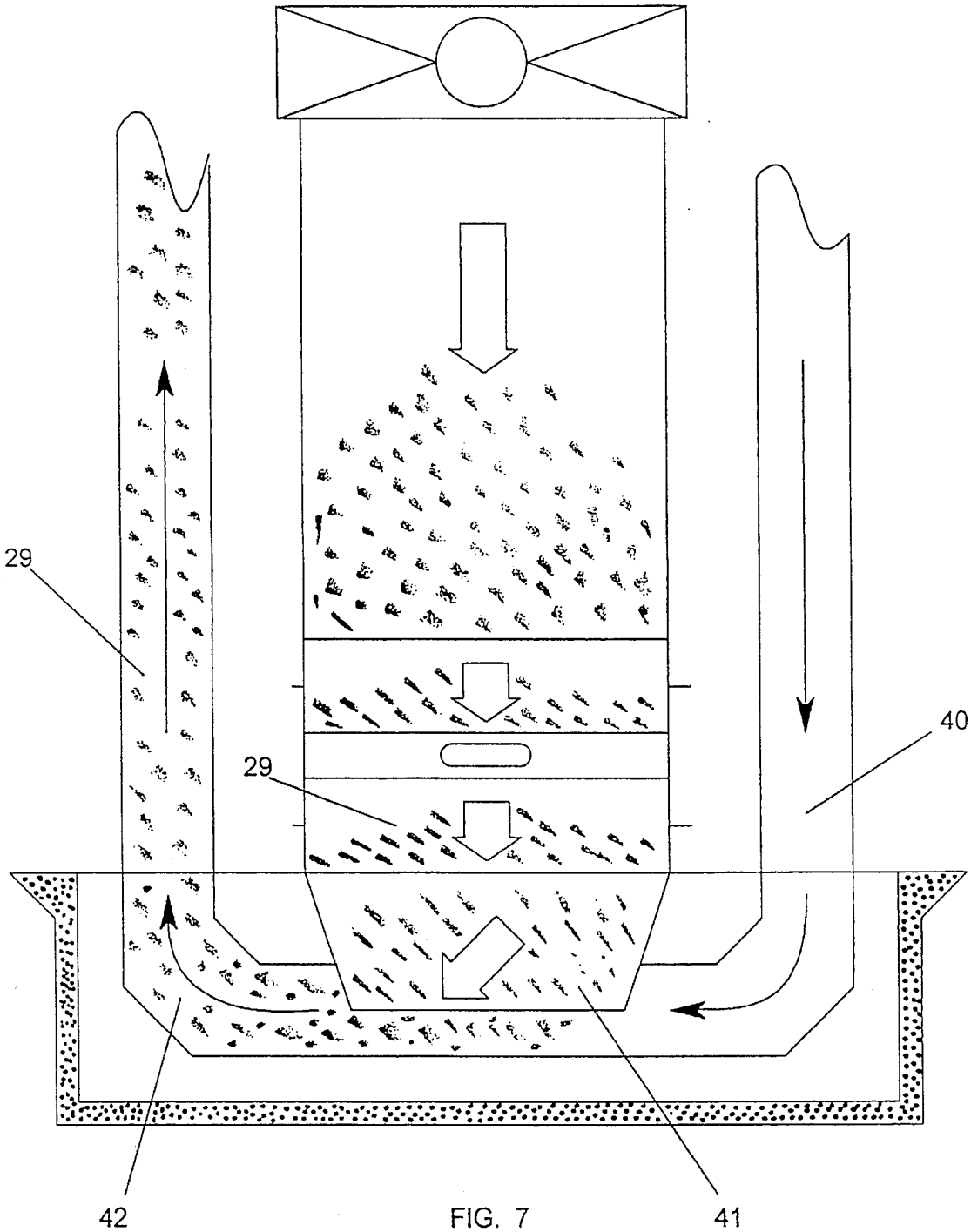
FIG. 7 is a detail view of the bottom of the feed mechanism of FIG. 3 showing clumps of fiber material passing through it.
Figures 8, 8A:
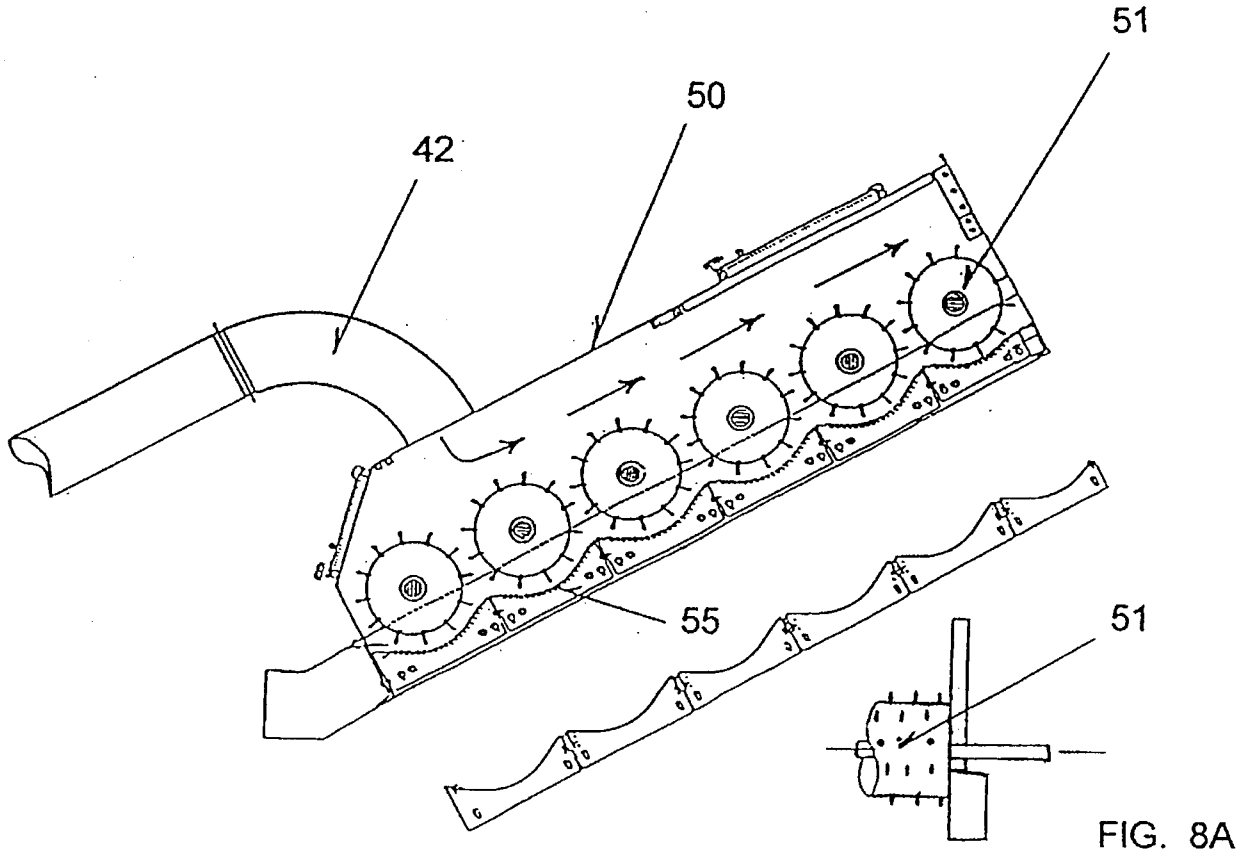
FIG. 8 is a diagrammatic side view of the incline dryer separator unit of the present invention.
FIG. 8A is a partial cut away end view of one of the spiked cylinders of the incline dryer separator unit shown in FIG. 8.

Detail of the entry of the clumps 29 into the hot air system is shown in FIGS. 6 and 7. Hot air is generated using fans 38 (see FIG. 1) and a furnace or in line burner 45 and blown through conduit 40 to an opening 41 at the bottom of feed chamber 26 under the lowermost vacuum wheel 37. Clumps of fiber drop from said lowermost vacuum wheel through opening 41 into conduit 42 where they are blown upward (see FIGS. 1 and 7).

As the clumps 29 travel through conduit 42 they are partially dried out making them more susceptible to easy separation. Clumps 29 are then introduced into an inclined fiber dryer separator 50. Here, the fiber clumps 29 ride across the top of several rotating spiked cylinders 51 (see FIGS. 8 and 8A) which further dry out and break up the clumps. The hot air and moisture is pulled through a perforated screen 55 having 3/16" holes therein below the spiked cylinders 51. As with the transition area, screen 55 prevents the fiber clumps 29 from being pulled with the air through the funnel and suction pipes (see FIG. 9).

Figure 14:
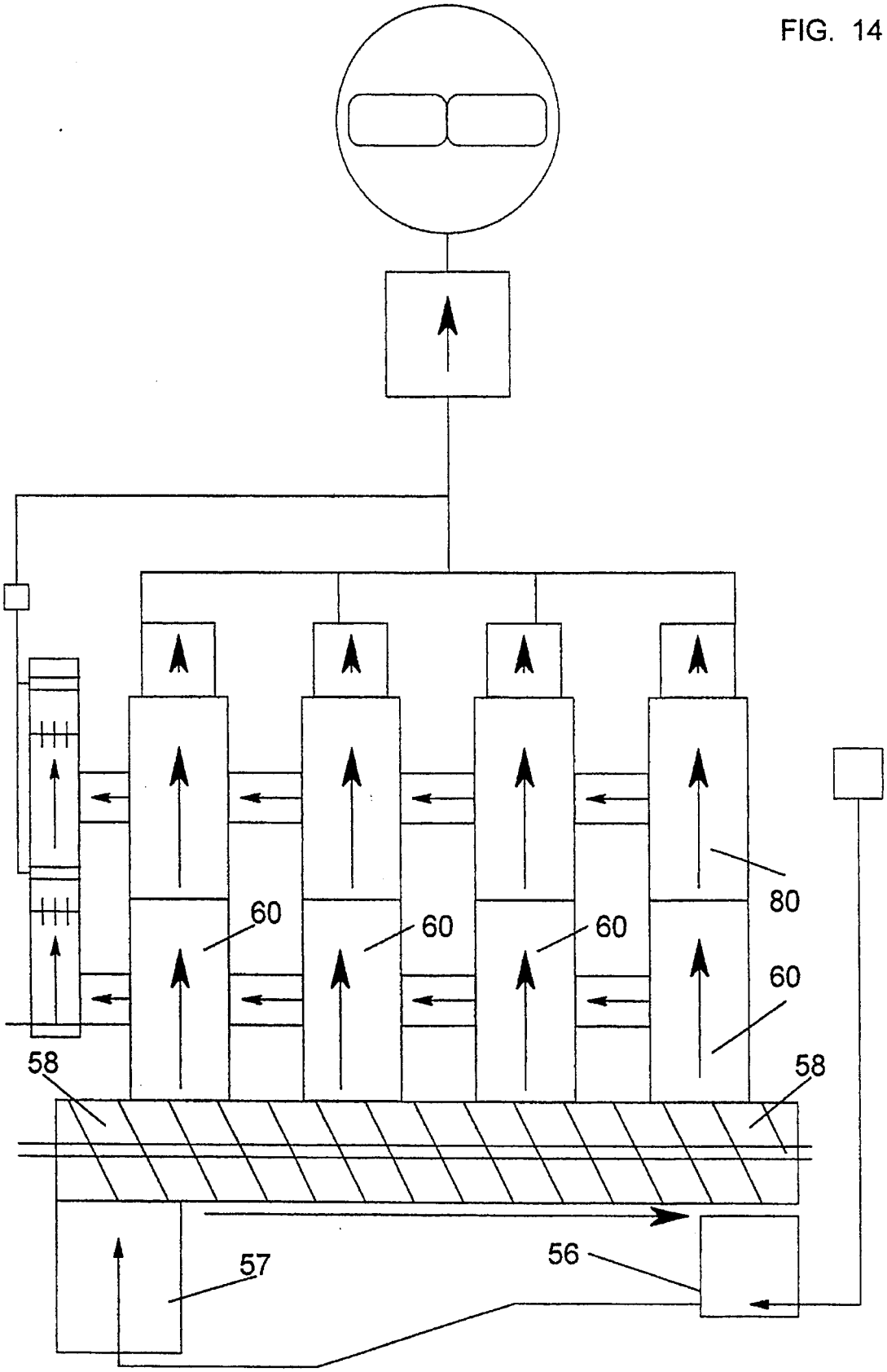
FIG. 14 is a diagram showing the flow of dried fibers onto an auger and distribution over up to four separate lines, each line containing (in this view) two fiber separators.

The dry and broken up fiber exits the inclined dryer at 56 and drops through vacuum wheel 57 onto a rotating auger (distributor) 58 (see FIG. 9) which distributes the fiber onto up to four separate lines, each line having at least one fiber core separator 60 therein (see FIG. 14). An auto feed control 141 (see FIG. 10A) includes a pair of rollers 142 that operate in the same way as feed control rollers 28, each line having its own auto feed control. As more fiber is introduced to the auger, more separation lines can be used, or the volume per line can be increased in order to handle the additional fiber. This allows the system to process 5, 10, 15 or 20 tons of fiber per hour.

Figure 11:
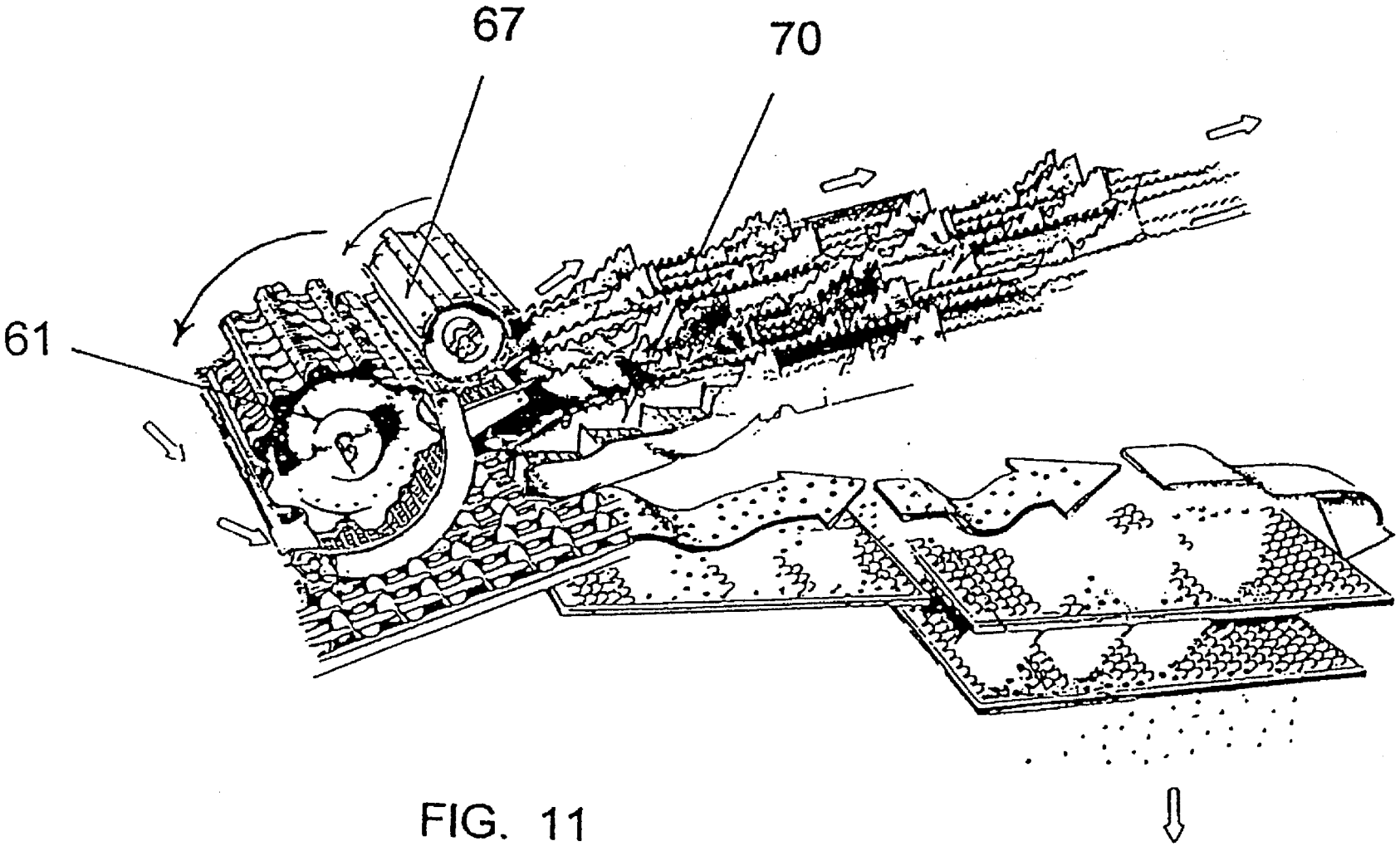
FIG. 11 is a perspective view of a typical fiber separator of the present invention.
Figure 12:
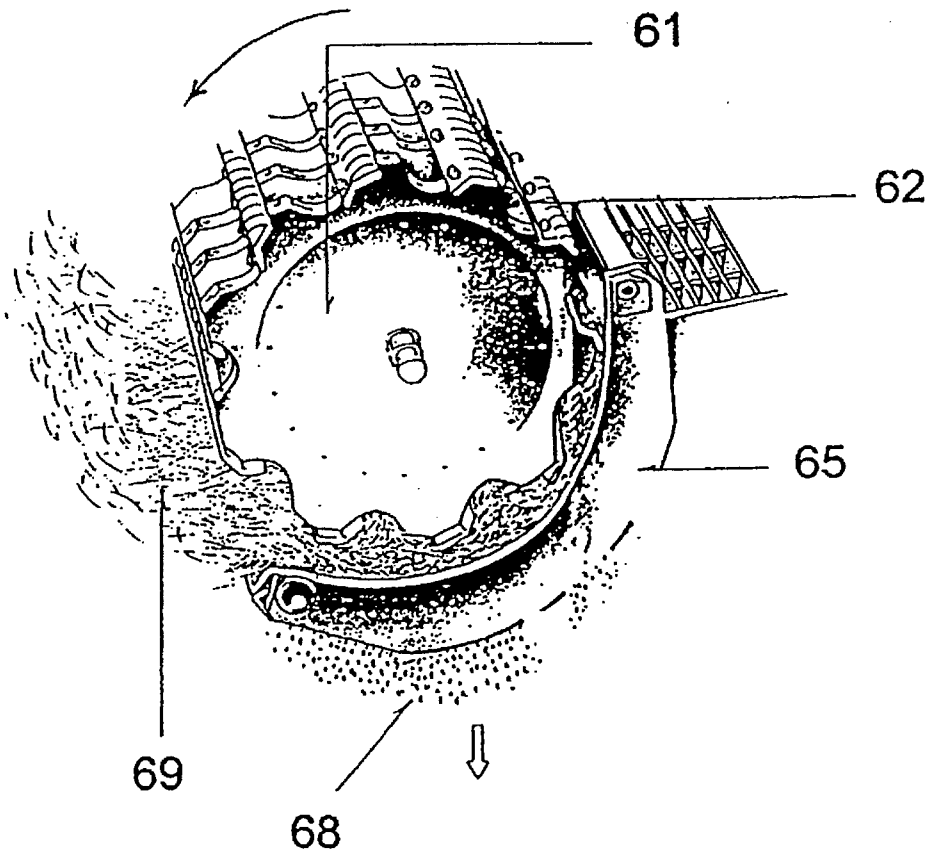
FIG. 12 is a detailed view of the spiked cylinder of the fiber separator shown in FIG. 11.

As shown in FIGS. 11 and 12, each core separator 60 includes a rotating cylinder 61 having a plurality of rows of spiked teeth 62 protruding outwardly therefrom mounted inside a semi-circular concave grate 65 attached to a housing 63 (not shown) which partially surrounds cylinder 61. Housing 63 (not shown) is open at the top in order to allow fiber to enter, and includes a set of several rows of spiked teeth 64 (not shown) protruding inwardly towards cylinder 61. Spiked cylinder 61 grabs the fiber and drags it through the housing 63 (not shown) and across grate 65 as partially shown in FIG. 12. As cylinder 61 rotates within housing 63 (not shown), cylinder teeth 62 intermesh in very close proximity with housing teeth 64 (not shown). As the fibers pass between the rapidly moving teeth of the cylinder and the stationary teeth of the housing, the core fibers 68 are broken away from the bast fibers 69. As the fibers travel around the cylinder 61, centrifugal force throws a significant volume of the heavier core pieces 68 down and through grate 65. The core pieces 68 then travel through a separate series of conveyors to the core cleaner (discussed below).

The remaining bast fibers 69 are caught by grate 65 and move upward until they reach a second, smaller rotating cylinder 67 (see FIG. 11). Cylinder 67 is provided slightly above and next to cylinder 61. It has an uneven surface and rotates in the same direction as cylinder 61. This rotation causes an air flow which pulls the bast fibers away from cylinder 61 and throws them forward onto a step pan 70 which moves the fiber upward and forward on to a set of inclined eccentric moving action conveyor separators 13.

Each conveyor 13 is provided with a plurality of openings across virtually the entire surface thereof, each of said openings having a small dimension. The conveyors shake and throw the fibers vigorously. Through this action, the heavier core fibers fall through the openings leaving the bast fibers on top of the conveyors, resulting in further separation.

The bast fibers 69 may then be introduced into a second identical core separator 80, or they may be dropped directly into the multi-saw bast fiber opener 90. The operation and action of the second core separator 80 is identical to the first core separator 60.

Figure 12A:
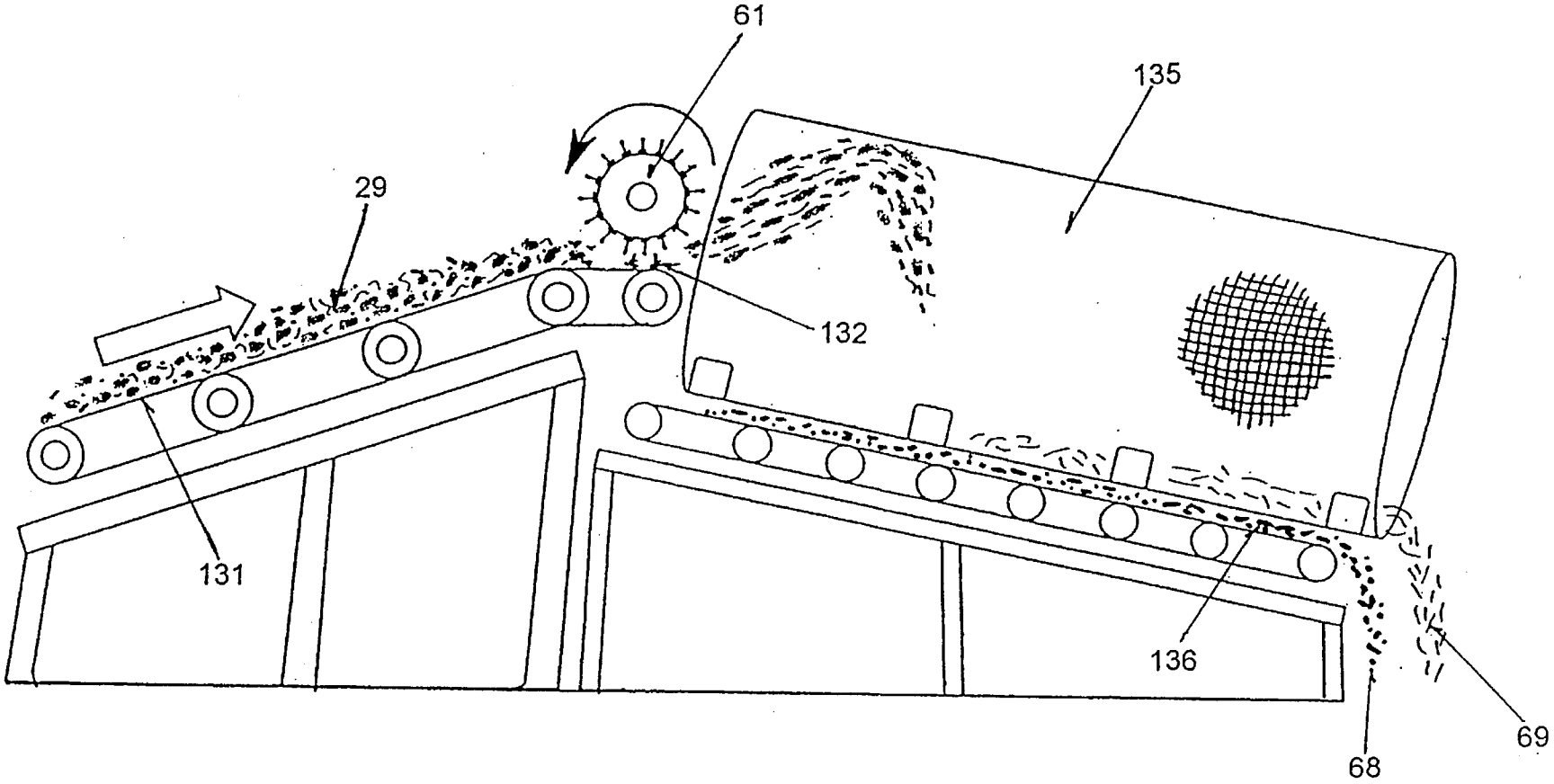
FIG. 12A is an alternative embodiment of a fiber separator.

An alternative fiber core separator is shown in FIG.. 12A. In this embodiment, the fiber clumps 29 are introduced onto a conveyor 131 from auger/distributor 58. The clumps ride upward until they reach rotating spiked cylinder 61 which is suspended above two sets of stationary spiked teeth 132. The spikes of cylinder 61 working with teeth 132 break up and throw the fiber clumps 29 into a rotating hollow wire-screened cylinder 135. The openings in the screen may be between one-inch, to one-half inch (1"–½") in size. A moving conveyor 136 is provided below cylinder 135. As cylinder 135 rotates, the heavier fiber core 68 fall through the openings onto conveyor 136 and are removed. The lighter bast fiber 69 exits out the end of cylinder 135 for further processing. This could include being sent into another conveyor and screened cylinder mechanism identical to that shown in FIG. 12A, introduction into another separator as shown in FIG. 11, or transfer to the multi-saw of FIG. 20.

Figure 20:
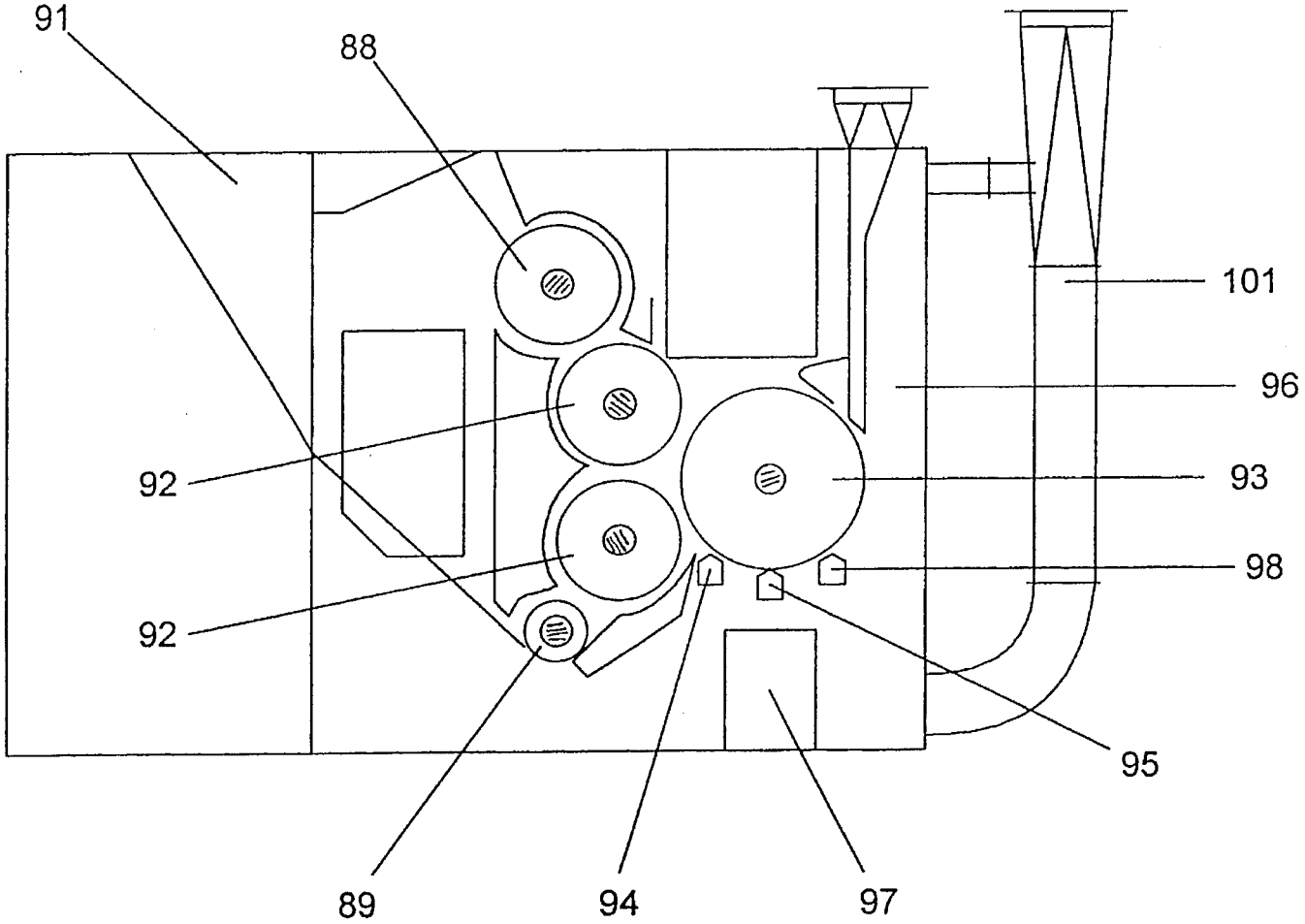
FIG. 20 is a diagrammatic side view of the multi-saw bast fiber opener with a non-positive feed control.

FIG. 20 shows the multi-saw bast fiber opener 90. The fiber drops into the opener at opening chamber 91 where it slides down and is brought into contact with a pair of opening saws 92. An overhead evener saw 88 keeps the fiber evenly distributed over the opening saws 92, and a variable drive feed saw 89 under opening saws 92 controls the flow of bast fiber to the opening and cleaning process to provide uniform opening.

All of the saws of opener 90 are made up of rotatable rolls around which a saw wire (having teeth thereon) has been wrapped. Each of the rolls is wrapped differently. Such saw wire wraps are spaced a pre-determined distance apart in order to maximize the cleaning and opening process. The saw wire itself is provided with teeth along its entire length; thus, when the saw wire is spirally wrapped around the cylinder, it provides the cylinder with a rough and jagged surface. Taller teeth provide a rough and coarse surface; whereas, shorter teeth provide a more fine surface. Similarly, close wire wrapping around the cylinder results in a more even surface; whereas, spaced wire wrapping results in a less even surface.

As the fibers come into contact with the first pair of saws 92, further separation of bast and core occurs. After this initial opening, the bast fiber is then processed by cylinder saw 93 over special mote knives 94 which eliminate the uncovered core particles. This allows for more intensive opening of fibers and exposure of more core particles. The exposed core particles are then eliminated by the subsequent mote knife 95 and discarded into the pin core compartment 97 which is designed for continuous automatic pin core removal. The opened cleaned bast fibers are then moved through the aspiration channel 96 by the cylinder saw 93. A stripper knife 98 in close proximity to the cylinder saw insures the removal of the fiber from the air stream.

Figure 9:
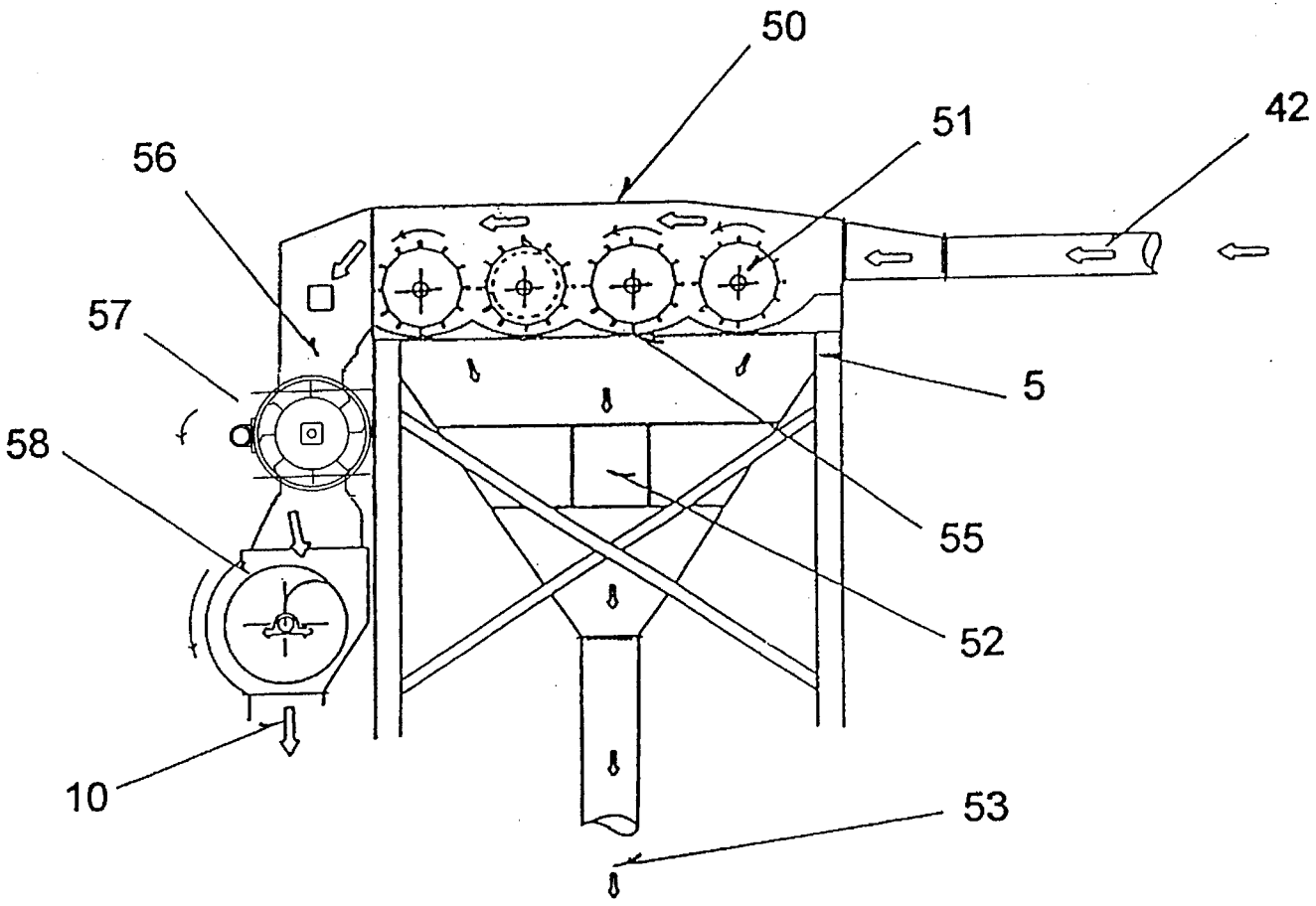
FIG. 9 is a diagrammatic side view of an alternative embodiment of the dryer separator unit of the present invention.
Figure 21:
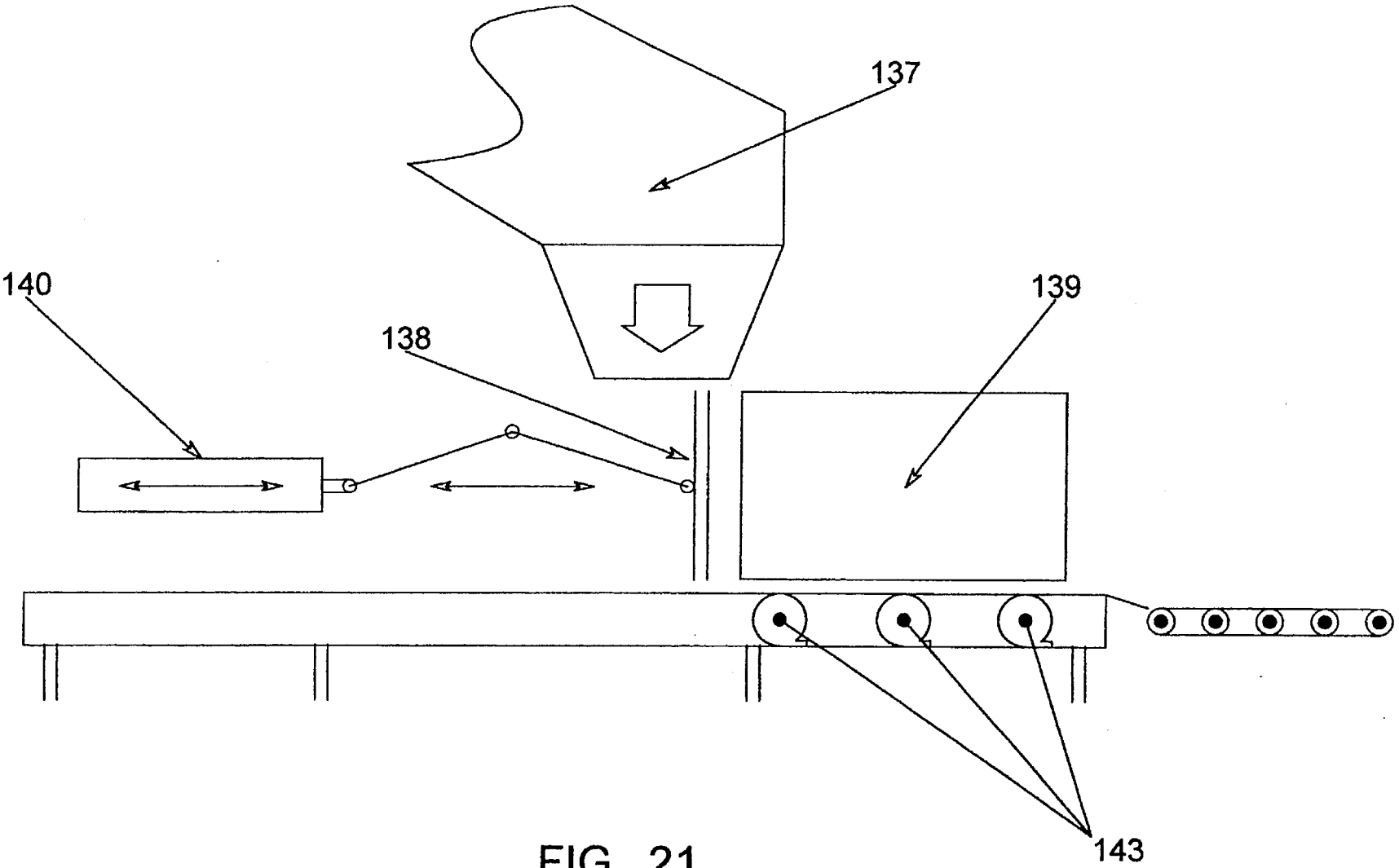
FIG. 21 is a diagrammatic side view of an alternative balepress.

The bast fiber which is now approximately ninety-nine percent (99%) clean may then be removed using a suction tube to another facility for further processing, or moved upward in preparation for baling using a suction device 105 similar to that shown in FIG. 9. Suction fan 104 pulls air through tube 103, funnel 102 and pipe 101 which are serially connected back to opener 90. The bast fiber is pulled through pipe 101, then across a set of rotating spiked cylinders 106 suspended over an air screen 107. The fibers fall into discharge chamber 108, and pass through another vacuum wheel 110 onto a lint slide 109 connected to a bale press 115 or a 1000-lb. hay bailer type fiber bailer (see FIG. 21). As an alternative, the fiber exiting the lint slide 109 can be discharged into fiber chamber 137 (see FIG. 21) and enters the fiber packer 138. The fiber is pushed into a bale chamber 139 by a hydraulic ram 140. The bale is automatically tied by an automatic string wrapper 143.

Figure 15:
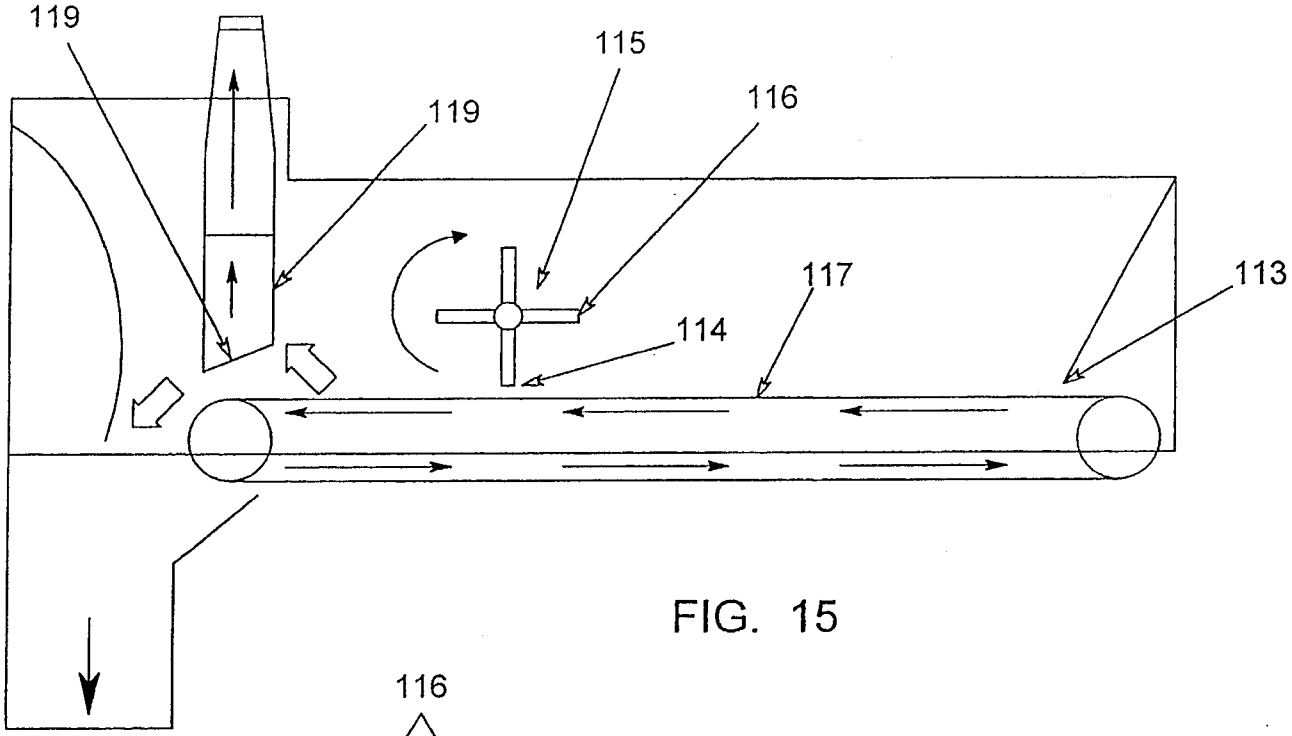
FIG. 15 is a diagrammatic side view of the core cleaner of the present invention.
Figure 16:
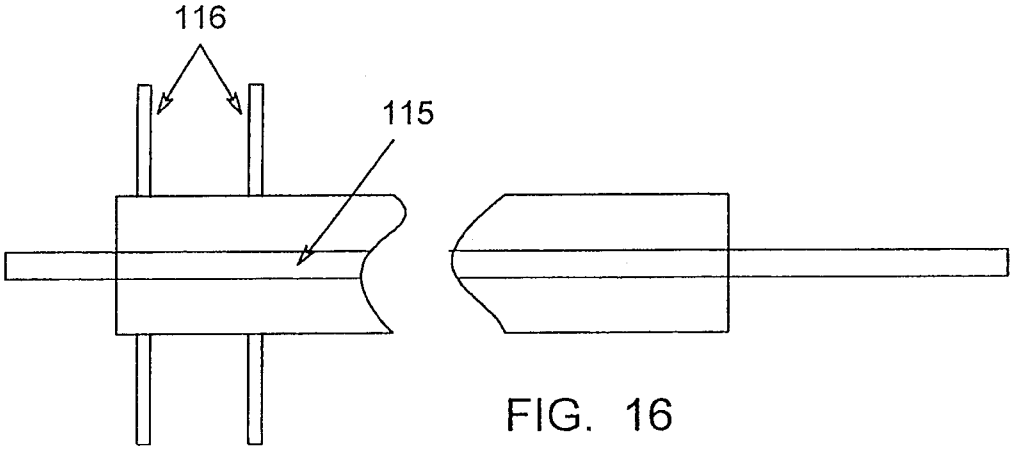
FIG. 16 is a diagrammatic top view of the rotatable spiked cylinder of the core cleaner of the present invention.

Core fiber that is produced from the core separators 60 and 80, as well as core fiber that is removed by the multi-saw cleaner 90 are brought via belt conveyors to a core cleaner (see FIGS. 15 and 16). Here, the core fiber is brought in on slide 113 and placed on conveyor 117 where it is passed under a rapidly rotating spiked cylinder 115. The distance 114 between conveyor 117 and the edges of the spikes 116 is approximately one and one-half inches (1½"). The rotation of the spikes 116 on cylinder 115 results in a high air flow which blows the bast fibers up from the core fibers. These separated bast fibers are removed using suction hood 119. The bast fibers are re-introduced into air line separator 105 so that they may be baled or further processed.

Figure 17:
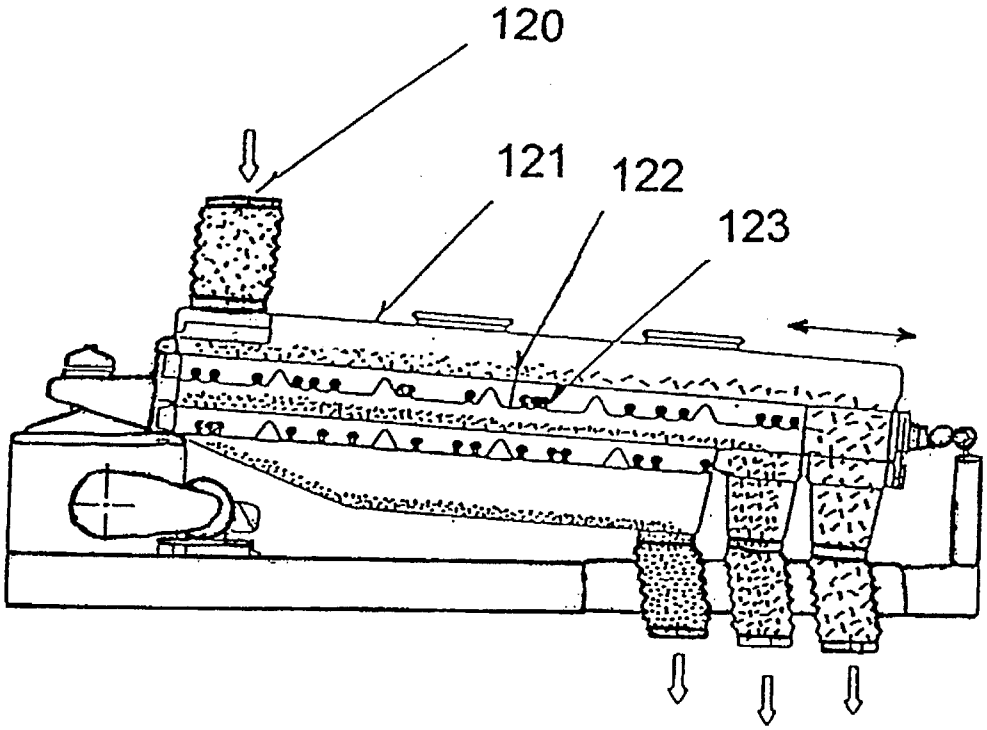
FIG. 17 is a diagrammatic side view of a shaker/sizer for receiving cleaned fiber core.

The core which is not blown off drops from conveyor 117 or is removed using deflector 118 and falls into storage bins or a sizing apparatus (see FIG. 17). FIG. 17 shows a shaker 121 having two separate screens of different sizes. Large core particles remain on the top screen 121; finer core particles drop through to the second screen 122 where they come into contact with agitation balls 123; the finest core particles drop through the second screen. The core fibers thus separated may be utilized for purposes appropriate to their sizes or discarded.

Figure 10:
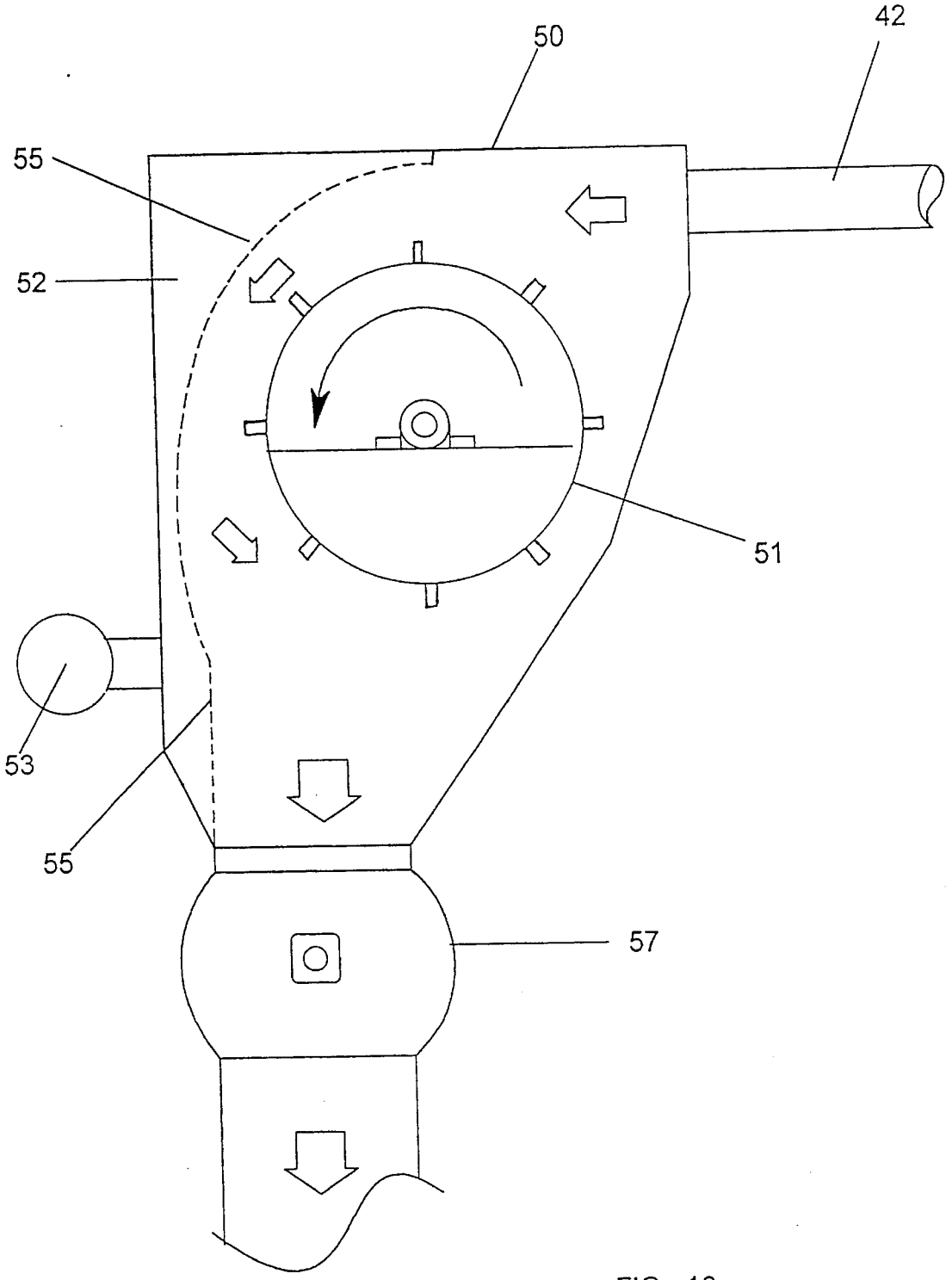
FIG. 10 is a diagrammatic side view of yet another alternative embodiment of the dryer separator unit of the present invention.
Figure 10A:
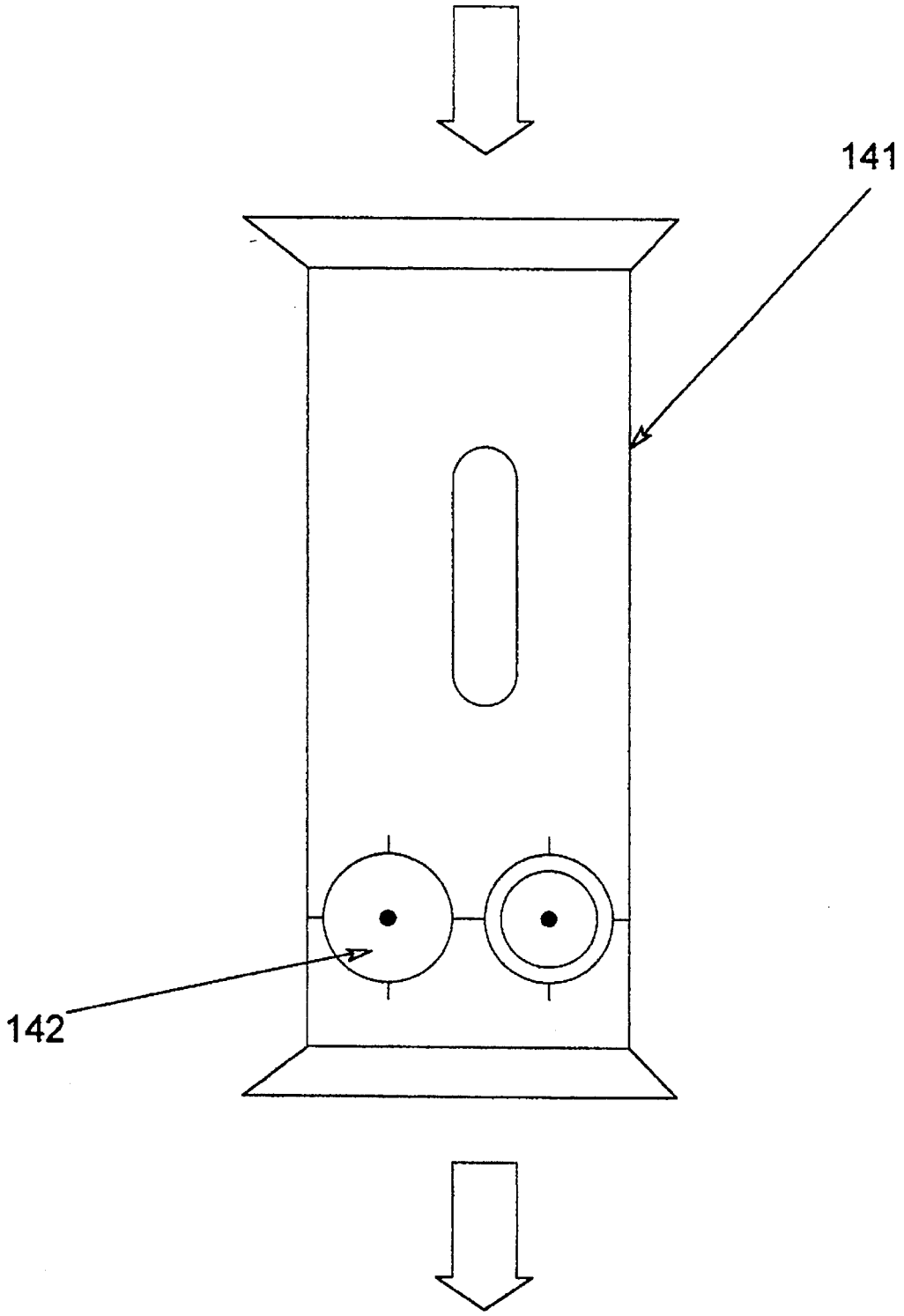
FIG. 10A is a diagrammatic side view of an auto feed control.

An alternative incline dryer separator unit is shown in FIG. 9. This unit is flat instead of angled, but functions in essentially the same way as the unit shown in FIG. 8. The unit shown in FIG. 9 may also be adapted for use as either the initial intake unit 21 of FIG. 2, or the final suction device 105. Similarly, the alternative unit shown in FIG. 10 may also be a replacement for each of these components.

Figure 13:
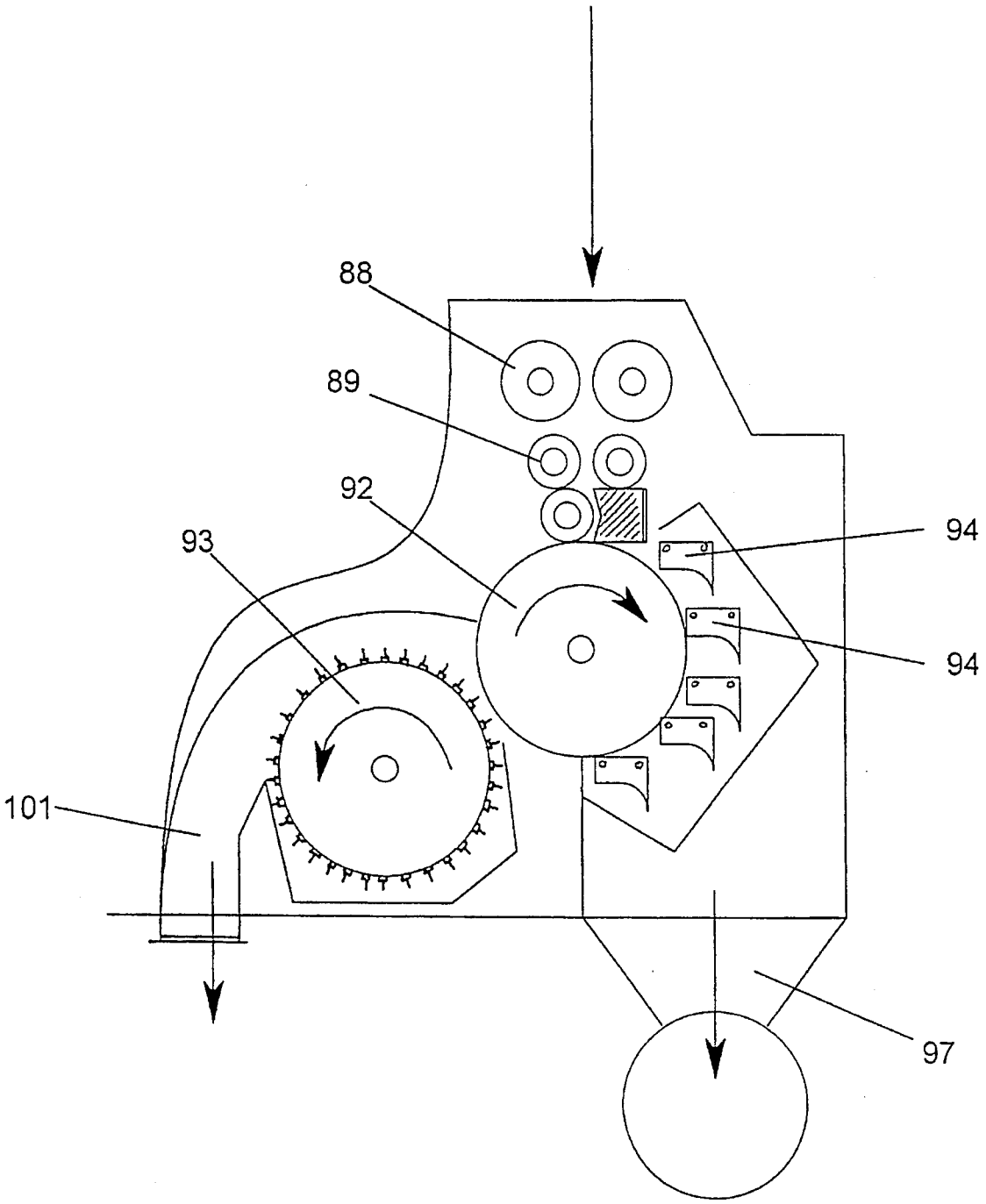
FIG. 13 is a detailed diagrammatic side view of the Moss Gordon Super Constellation fiber separator.

An alternative unit for cleaner 90 is shown in FIG. 13. This unit also includes a cleaning saw 92 which receives the incoming fiber after it passes through evening and variable speed perforated rollers 88 and 89. Saw 92 brings the fiber into contact with a series of mote knives 94 which eliminate the core particles that drop into discharge 97. The bast fiber is then brought over brush cylinder 93 into transfer pipe 101.

DESCRIPTION OF THE PREFERRED EMBODIMENTS

In the preferred embodiment, it is important that the method of separating the bast and core fibers begin with harvesting the fibers in the field using a specific cut length of no less than three inches (3") nor more than eight inches (8"). The optimum range is between three inches (3") and five inches (5"). Stalks so harvested are compressed into large modules and transported to a processing plant where they are moved through the various processing steps using air suction.

In the preferred embodiment, fan 30 as well as fan 104 is a double-196 fan (19" inlet and 6" fan) running in tandem at approximately 8,500 cfm. Fan 30 is used to pull the unseparated fibers from the module 19, and fan 104 is used to pull the separated bast fiber out of the system for packing, baling or storage. Dryer fan 38 is a single-196 fan running at approximately 8,000 cfm. Six (6) spiked cylinders 51 are provided in fiber dryer separator 50, and the holes in the perforated screen 55 below these cylinders should be approximately three-sixteenths inch (3/16") in order to pull only air, but not fiber through.

The burner 45 (see FIG. 1) should be a Lummus 3 million BTU in-line burner powered by a single 196 Lummus push fan. Drying occurs in the full length of conduit 42 and across the top of the cylinders of the fiber dryer separator 50.

In the core cleaner (FIGS. 15 and 16), spiked cylinder 115 has a shaft approximately thirty-one inches (31") long, and one inch (1") in diameter, with spikes 116 of approximately four inches (4") in length. Cylinder 115 rotates at approximately 1,600 rpm and has a clearance above conveyor 117 of approximately one and one-half inches (1½"). Ten rows of four spikes each 116 are provided on shaft 115. Each of the four spikes in each row is spaced ninety degrees (90° ) apart, and offset one-fourth inch (¼"). Each of the rows of spikes is spaced two and three-fourths inches (2¾") apart. The distance from the rotating cylinder 115 to the suction hood 119 should be approximately 48 inches (48").

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. A method for separating the long outer bast fibers from the short woody inner core fibers of herbaceous fiber producing plants comprising the steps of:

a. harvesting the plants into clumps using a short cut length;

b. introducing the clumps of plants so harvested into a conditioning and drying apparatus wherein said clumps are broken up into small pieces and dried;

c. introducing said dried and broken up plant clumps into an auger for distribution into one of a plurality of separator lines;

d. processing said plant clumps in each line by introducing said clumps into a first fiber separator wherein the dried clumps come into contact with a rotating spiked cylinder partially surrounded by a grated housing, said cylinder mounted adjacent to a means for producing air flow, said means mounted adjacent to a plurality of upwardly inclined moving conveyor surfaces having openings therein, whereby many of the heavier woody inner core fibers are thrown through said grated housing, leaving the lighter bast fibers to pass onto said moving conveyor by said air flow means such that as said conveyors move upward, more of the heavier woody inner core fibers drop through the openings therein;

e. introducing the bast fibers from the previous step into a multi-saw opener and cleaner wherein said fibers come into contact with a plurality of oppositely rotating cylinders around which a variety of different spiked wires have been tightly wrapped, such that the opposing forces of said rotating cylinders tear the bast fibers apart, further separating them from any remaining woody inner core fibers which drop through said saw;

f. introducing the bast fibers from the previous step into a baling apparatus for compact storage.

2. The method described in claim 1 above wherein the bast fiber from the first fiber separation step is processed through a second identical fiber separation step before being introduced into the multi-saw cleaner.

3. The method described in claim 1 above wherein the cut length of the harvested plants is between three inches (3") and five inches (5").

4. The method described in claim 1 above wherein the inner core fibers are transported via air suction to a moving conveyor over which a small-diameter rapidly rotating spiked cylinder is suspended for blowing any remaining bast fibers away from said inner core fibers such that said bast fibers are introduced through a suction means into said bailing apparatus.

5. The method described in claim 4 above wherein said suction means is comprised of a hood attached through conduit means to a fan, said hood being located above said conveyor approximately forty-eight inches (48") from said small-diameter spiked cylinder.

6. The method described in claim 4 above wherein said small-diameter spiked cylinder is suspended approximately one and one-half inches (1½") above said conveyor.

7. The method described in claim 1 above wherein said first fiber separator is instead comprised of a moving conveyor onto which said dried plant clumps are introduced, said conveyor bringing said clumps into contact with an overhanging rotating spiked cylinder suspended over at least one row of stationary spikes whereby said clumps are broken apart and thrown into a large hollow angled rotating screened cylinder through which the heavy core fibers fall through, and out of the end of which said separated bast fibers exit.

8. The method described in claim 1 above wherein said drying apparatus is comprised of a longitudinal in-line burner attached at one end to conduit means leading to a fan, and attached at the opposite end to conduit means leading to an opening into which said clumps enter said conduit, whereby the air from said fan is heated as it passes through said burner so that as said clumps are introduced into said conduit, they are dried by the hot air.

9. The method described in claim 8 above wherein a plurality of vacuum ports are provided in said conditioning and drying apparatus to allow for controlled entry and removal of said clumps from said apparatus thereby preventing said clumps from being sucked into said fans or blown out of said apparatus with escaping air.

10. The method described in claim 9 above wherein a feed control comprising a pair of closely spaced rotating cylinders is provided at the entry to the conditioning and drying apparatus for controlling the amount of fiber introduced into the apparatus.

11. An apparatus for separating the long outer bast fibers from the short woody inner core fibers of herbaceous fiber producing plants comprising:

a. a suction means for pulling up clumps of harvested fibers;

b. a feed control means attached to said suction for controllling the quantity and speed of introduction of said clumps into said apparatus;

c. a dryer means comprising a heater and blower attached to a conduit, said conduit having an opening therein connected to said feed control for receiving said fiber clumps and carrying them through a distance to an air separator;

d. an air separator having a plurality of rotating spiked cylinders therein wherein said dried fiber clumps are broken apart into smaller pieces;

e. an auger distributor attached to said air separator for receiving said dried fiber clumps and distributing them over a plurality of separator lines;

f. at least one fiber core separator in each line comprising a rotating spiked cylinder partially surrounded by a grated housing, said cylinder mounted adjacent to a means for producing air flow, said means mounted adjacent to a plurality of upwardly inclined moving conveyor surfaces having openings therein, whereby many of the heavier woody inner core fibers are thrown through said grated housing, leaving the lighter bast fibers to pass onto said moving conveyor by said air flow means such that as said conveyors move upward, more of the heavier woody inner core fibers drop through the openings therein;

g. a multi-saw opener and cleaner attached to the output of said core separator comprising a plurality of oppositely rotating cylinders around which a variety of different spiked wires have been tightly wrapped, such that the opposing forces of said rotating cylinders tear the bast fibers apart, further separating them from any remaining woody inner core fibers which drop through said saw;

f. a baling apparatus for compacting said cleaned bast fiber.

12. The apparatus described in claim 11 above wherein a second identical fiber core separator is provided between the first fiber core separator and the multi-saw cleaner.

13. The apparatus described in claim 11 above wherein an inner core cleaner is provided for receiving the core fiber from said separator and multi-saw, said cleaner comprising a conveyor over which a small-diameter rapidly rotating spiked cylinder is suspended for blowing any remaining bast fibers away from said inner core fibers, and a suction hood for introducing said bast fibers into said bailing apparatus.

14. The apparatus described in claim 11 above wherein said first fiber separator is instead comprised of a moving conveyor onto which said dried plant clumps are introduced, said conveyor bringing said clumps into contact with an overhanging rotating spiked cylinder suspended over at least one row of stationary spikes whereby said clumps are broken apart and thrown into a large hollow angled rotating screened cylinder through which the heavy core fibers fall through, and out of the end of which said separated bast fibers exit.

15. The apparatus described in claim 11 above wherein the inner core fibers are transported via air suction to a moving conveyor over which a small-diameter rapidly rotating spiked cylinder is suspended for blowing any remaining bast fibers away from said inner core fibers such that said bast fibers are introduced through a suction means into said bailing apparatus.

16. The apparatus described in claim 15 above wherein said suction means is comprised of a hood attached through conduit means to a fan, said hood being located above said conveyor approximately forty-eight inches (48") from said small-diameter spiked cylinder.

17. The apparatus described in claim 15 above wherein said small-diameter spiked cylinder is suspended approximately one and one-half inches (1½") above said conveyor.

18. The apparatus described in claim 11 above wherein said drying apparatus is comprised of a longitudinal in-line burner attached at one end to conduit means leading to a fan, and attached at the opposite end to conduit means leading to an opening into which said clumps enter said conduit, whereby the air from said fan is heated as it passes through said burner so that as said clumps are introduced into said conduit, they are dried by the hot air.

19. The apparatus described in claim 18 above wherein a plurality of vacuum ports are provided in said conditioning and drying apparatus to allow for controlled entry and removal of said clumps from said apparatus thereby preventing said clumps from being sucked into said fans or blown out of said apparatus with escaping air.

* * * * *